US006214171B1

(12) United States Patent
Snekkenes

(10) Patent No.: US 6,214,171 B1
(45) **Date of Patent: *Apr. 10, 2001**

(54) TOP SEPARATOR IN A CONTINUOUS DIGESTER SYSTEM

(75) Inventor: Vidar Snekkenes, Karlstad (SE)

(73) Assignee: Kvaerner Pulping AB (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/367,166

(22) PCT Filed: Feb. 9, 1998

(86) PCT No.: PCT/SE98/00224

§ 371 Date: Aug. 6, 1999

§ 102(e) Date: Aug. 6, 1999

(87) PCT Pub. No.: WO98/35092

PCT Pub. Date: Aug. 13, 1998

(30) Foreign Application Priority Data

Feb. 10, 1997 (SE) ..... 9700435

(51) Int. Cl.[7] ..... D21C 7/06; D21C 7/14

(52) U.S. Cl. ..... 162/245; 162/251; 210/413

(58) Field of Search ..... 162/39, 72, 90, 162/45, 76, 245, 251; 210/413

(56) References Cited

U.S. PATENT DOCUMENTS

| | | | | |
|---|---|---|---|---|
| 5,882,477 | | 3/1999 | Laakso et al. | 162/63 |
| 5,885,414 | | 3/1999 | Lindstrom et al. | 162/19 |
| 6,086,717 | * | 7/2000 | Snekkenes et al. | 162/245 |

* cited by examiner

*Primary Examiner*—Dean T. Nguyen
(74) *Attorney, Agent, or Firm*—Fasth Law Offices; Rolf Fasth

(57) ABSTRACT

A method in connection with continuous cooking of chips that comprises impregnating the chips with a impregnation liquid in an impregnation vessel and cooking the impregnated chips in a digester. The impregnation vessel and digester are connected to one another by means of a transfer circulation, which partly, via a feed line feeds the chips from an outlet end of the impregnation vessel to the top of the digester for separation of a free liquid in a separator. The separated liquid from the top of the digester is, partly, via a return line fed to the outlet end of the impregnation vessel for use as a transfer liqid for the impregnated chips to which cooking liquid is added to the chips at the top of the digester. Less than 100%, preferably less than 95%, and more preferred less than 90% of the liquid that is separated from the chips in the transfer circulation is recirculated to the used as transfer liquid.

8 Claims, 12 Drawing Sheets

FIG. 6

LABORATORY COOKING

GENERAL CONDITIONS

| | |
|---|---|
| Wood specie: | Scandinavian softwood, chips |
| Steaming, minutes | 5 |
| Temperature, °C | 110 |
| Pressure, bar | 1.0 |
| Sulfidity, % | 36.4 |

SPECIFIC CONDITIONS

| Cook no. | Reference ITC 1770 | Present Invention ITC 1763 |
|---|---|---|
| IMPREGNATION | | |
| Time, minutes | 45 | 45 |
| Temperature, °C | 125 | 125 |
| Alkali consumption, kg EA/BDMT wood | 99 | 92 |
| CONCURRENT COOKING | | |
| Time, minutes | 120 | 120 |
| Temperature, °C | 160 | 145 |
| Alkali consumption, kg EA/BDMT wood | 63 | 66 |
| COUNTERCURRENT COOKING | | |
| Time, minutes | 150 | 150 |
| Temperature, °C | 160 | 155 |
| Alkali consumption, kg EA/BDMT wood | 15 | 10 |
| RESULTS | | |
| H-Factor | 1850 | 874 |
| Alkali consumption, kg EA/BDMT wood | 177 | 168 |

NEW CONCEPT : $O^2$ Kappa 11.1 and visc. 1018 $dm^3/kg$

Reference cooked pulp: $O^2$ Kappa 11.2 and visc. 1014 $dm^3/kg$

TOP SEPARATOR IN A CONTINUOUS DIGESTER SYSTEM

TECHNICAL FIELD

The present invention relates to a novel top separator and a method for producing pulp, preferably sulphate cellulose, with the aid of continuous digester systems.

BACKGROUND AND SUMMARY OF THE INVENTION

Environmental demands has forced our industry to develop improved cooking and bleaching methods. One recent breakthrough within the field of cooking is ITC™, which was developed in 1992–1993. ITC™ is described in WO-9411566, which shows that very good results concerning the pulp quality may be achieved. ITC™ is mainly based on using almost the same temperature (relatively low compared to prior art) in all cooking zones in combination with moderate alkaline levels. The ITC™-concept does not merely relate to the equalization of temperatures between different cooking zones, but a considerable contribution of the ITC™-concept relates to enabling an equalized alkaline profile also in the lower part of the counter-current cooking zone.

Moreover, it is known that impregnation with the aid of black liquor can improve the strength properties of the fibers in the pulp produced. The aim of the impregnation is, in the first place, to thoroughly soak each chip so that it becomes susceptible, by penetration and diffusion, to the active cooking chemicals which, in the context of sulphate cellulose, principally consist of sodium hydroxide and sodium sulphide.

If, as is customary according to prior art, a large proportion of the white liquor is supplied in connection with the impregnation, there will exist no distinct border between impregnation and cooking. This leads to difficulties in optimizing the conditions in the transition zone between impregnation and cooking.

Now it has been found that surprisingly good results can be achieved when:

1. Keeping a low temperature but a high alkali content in the beginning of a concurrent cooking zone of the digester;
2. Withdrawing a substantial part of a highly alkaline spent liquor that has passed through at least the concurrent cooking zone; and
3. Supplying a substantial portion of the withdrawn spent liquor that has a relatively high amount of rest-alkali, to a point that is adjacent the beginning of an impregnation zone.

This leads to a reduced H-factor demand, reduced consumption of cooking chemicals and better heat-economy. Additionally, the novel method leads to production of pulp that has a high quality and a very good bleachability, which means that bleach chemicals and methods can be chosen with a wider variety than before for reaching desired quality targets (brightness, yield, tear-strength, viscosity, etc.) of the finally bleached pulp. This novel process is defined in more detail in our co-pending application PCT/SE97/00192.

The present invention relates to a preferred method and device for practising the above. In connection with the continuous cooking of cellulose containing fibre material, it comprises impregnation of the fibre material with an impregnation liquid in an impregnation vessel and cooking of the impregnated fiber material in a digester, the impregnation vessel and the digester being connected to each other by a transfer circulation, which, via a feed line, feeds the fibre material from an outlet end of the impregnation vessel to the top of the digester, which feed line comprises a separator for separation of free liquid from the fibre material and, which via a return line, feeds separated liquid back to the outlet end of the impregnation vessel for use as transfer liquid for the impregnated fibre material. Cooking liquid, is added to the fibre material after separation of the free liquid, preferably in connection with the top of the digester, downstream said separation of liquid.

According to conventional technique for withdrawal of liquid from the cooking system, this is normally done directly from the withdrawal strainer of the digester itself. Alternatively in connection with a two vessel system the impregnation vessel, may be supplied with fresh cooking liquor and equipped with a screening device, from which some of the withdrawn liquid is transferred to a recovery plant, possibly after first having passed a flash cyclone. The use of such a screening device involves a considerable cost, due to a special construction of the impregnation vessel being necessary, assembly of conduits and installation of screens, blind plates, nozzles, a possible central line and different instruments in addition to labour for assembling, welding etc. In addition to this there are difficulties in optimizing the withdrawal at this point. Moreover the operating costs of such a screening device is not neglectable. Furthermore the addition of white liquor (fresh cooking liquid) within the impregnation vessel or in the transfer circulation line leads to difficulties in optimizing the process. Firstly when supplying to the impregnation vessel it can be difficult to achieve sufficient mixing of the added white liquor in the impregnation vessel, leading to varying levels of alkaline in different parts. Secondly different kind of wood chips may consume varying amounts of alkaline, making it more difficult to optimize the conditions in the impregnation vessel. It is even claimed that the above might have a bad influence on cost and the quality of pulp, since if a too high amount of alkaline exists in connection with the mechanical action of the outlet scraper might deteriorate fibre strength.

The object of the present invention is to improve and simplify the cooking department with respect to withdrawal and supply of liquid from the cooking system. This is achieved by the use of a new method in connection with a new separator, also leading to a simplified construction of the impregnation vessel with resulting savings in material and costs and to a better way of optimizing withdrawal and supply of liquid thereby also creating conditions for a better utilisation of the cooking liquid.

The device according to the invention is characterised by a separator for wood chips disposed in the feed line between an impregnation vessel and a digester comprising:

- a screw feeder having an inlet end and an outlet end for feeding wood chips in an upward direction from the inlet end towards the outlet end of the screw feeder;
- a rotatable shaft in operative engagement with the screw feeder;
- a drive unit secured to the rotatable shaft for rotating the rotatable shaft;
- a cylindrical screen basket enclosing the screw feeder; and
- a liquid collecting space enclosing the cylindrical screen basket for separating a substantial portion of a free liquid, the liquid collecting space being in fluid communication with a return line connected to the outlet of the impregnation vessel; and a distribution means for supplying a cooking liquid to the fiber material, said distribution means being positioned downstream of the collecting space in relation to the flow of the chips.

According to a further aspect of the invention, less than 100%, preferably less than 95% and more preferred less than 90% of the liquid which is separated from the fibre material in the transfer circulation is recirculated to be used as transfer liquid for the impregnated fibre material and/or to be re-used in connection with the impregnation vessel, either as a transfer liquid or as an impregnation liquid.

Further the apparatus according to the invention is characterised in that it comprises a connection, which stretches from the liquid chamber of the separator to a recovery plant, for withdrawal of a second part of the liquid which is separated by the separator from the cooking system.

According to a preferred embodiment of the invention, the mixture of fibre material and impregnation liquid is fed through the entire impregnation vessel, without liquid being withdrawn from the cooking via the impregnation vessel, besides which a second part of the liquid which is separated in the separator is transferred to recovery.

It is preferred that the second part of the withdrawn liquid is allowed to flash before the recovery.

The second part of the withdrawn liquid may suitably constitute at most 20 m3/ADMT of pulp and at least 0.5 m3/ADMT of pulp, preferably at least 2 m3/ADMT of pulp and more preferred at least 4 m3/ADMT of pulp. It is suitable that liquid is separated from the fibre material in a controlled amount, so that the fibre material contains at least 0.5 m3 free liquid/ADMT of pulp.

According to yet another preferred embodiment of the invention, cooking liquid is added to the separator after separation of liquid in order to be intimately mixed with the fibre material which is poor in liquid, by influence of an upwards feeding screw in the top separator.

The said second part of liquid is suitably withdrawn from said return line via a branch line, directly or indirectly, outside the fibre material to the recovery without any essential part thereof being recirculated to the digester.

BRIEF DESCRIPTION OF THE DRAWINGS

The invention will in the following be further explained by an example, with reference to the drawings.

FIG. 6 shows which conditions were used in the laboratory for one of the ITC-references and one of the cooking methods according to the invention (so called modified ITC);

DETAILED DESCRIPTION

The invention is described in connection with the production of sulphate pulp with wood chips as raw material, but it is of course applicable for production of other types of pulp and with any type of suitable raw materials consisting of cellulose containing fibre material, e.g. bagasse, saw dust, etc.

Figure 1:
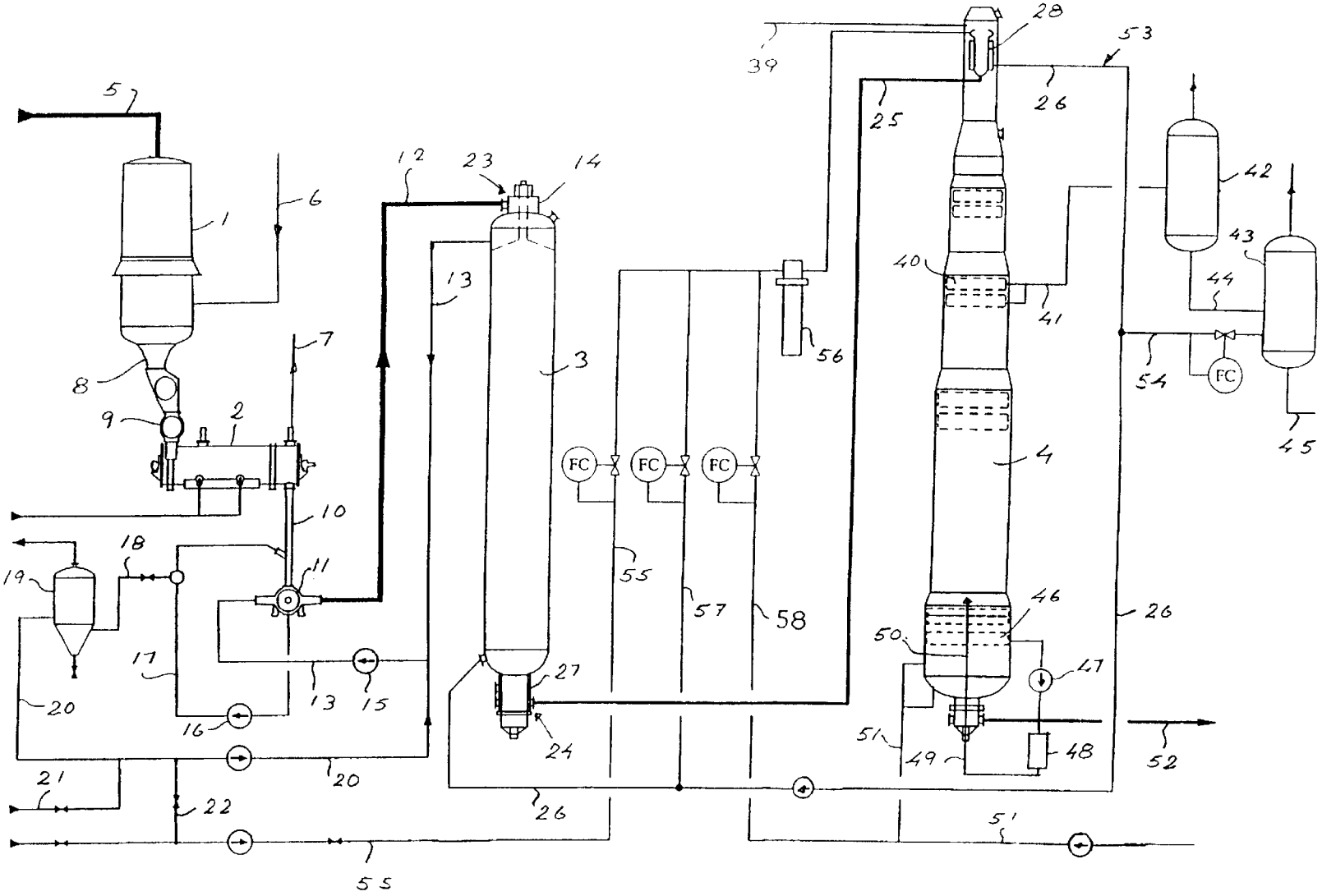
FIG. 1 shows schematically a preferred two vessel digester according to the invention.

The apparatus which is schematically shown in FIG. 1 comprises a vertical steaming vessel 1, a horizontal steaming vessel 2, a vertical impregnation vessel 3 and a vertical digester 4, which operates according to the steam-liquid phase principle. The horizontal steaming vessel may be excluded if wished. The chips are fed through a line 5 to the vertical steaming vessel 1, to which low pressure steam or alternatively flash steam is added through a line 6 for heating of the chips and decreasing their content of air. Separated air can be removed through a line 7, which is connected to the horizontal steaming vessel 2. This pre-steaming is conducted at atmospheric pressure. The heated chips are measured with a chip meter, which is arranged in a connection 8 between the two steaming vessels 1, 2, which connection 8 also comprises a low pressure feeder 9, which sluices the chips into the horizontal steaming vessel 2, in which the pressure is 1–1.5 bar overpressure. The chips fall from the pressurised steaming vessel 2 into a chute 10, which has a high pressure feeder 11 arranged in its lower part. A certain level of liquid is maintained in the chute 10.

Between the high pressure feeder 11 and the impregnation vessel 3, there is a top circulation, which comprises a feed line 12 for a mixture of chips and impregnation liquid, and a return line 13 for separated impregnation liquid. A downwards feeding top separator 14 is arranged in the top of the impregnation vessel 3 for feeding of the chips into the impregnation vessel at the same time as a part of the impregnation liquid is separated off and is pumped with a pump 15 through the return line 13, back to the high pressure feeder 11. The high pressure feeder 11 is equipped with a rotor with pockets, whereby one pocket always is in low pressure position, to be in open connection with the steaming vessel 2 and one pocket always, at the same time, is in high pressure position, to be in open connection with the impregnation vessel 3 via the feed line 12, which is connected to the top of the impregnation vessel. When a rotor pocket, which is filled with chips, arrives in high pressure position, that is in direct connection with the top circulation, it is flushed clean by the liquid from the return line 13, and the suspension of chips and impregnation liquid is fed into the top of the impregnation vessel 3 via the feed line 12. Liquid, in a circulation loop 17, which is equipped with a pump 16, is at the same time feeding chips from the chute 10 into one of the pockets of the high pressure feeder so that this pocket is filled with chips. The circulation loop 17 is, via a line 18, connected with a level tank 19, which in its turn, via a line 20, is connected to the return line 13 of the top circulation.

Suitable impregnation liquid, which may comprise black liquor and white liquor and optionally other chemicals, is added to the top circulation. Black liquor is added through a line 21 and white liquor through a line 22, which two lines are connected to the return line 13, via the line 20.

The impregnation vessel 3, itself, is, in accordance with the present invention, in the shown embodiment, completely free from an arrangement for withdrawal of liquid from the impregnation phase of the cooking system, at a location between the inlet 23 and the outlet 24 of the impregnation vessel. Consequently, the impregnation vessel 3 presents a longish cylindrical tube, which is completely free from a cost increasing withdrawal screen for withdrawal of liquid from the impregnation phase and removal of this liquid from the cooking system.

Between the impregnation vessel 3 and the digester 4, there is a transfer circulation, which comprises a feed line 25 for the mixture of impregnated chips and liquid and a return line 26 for separated liquid. The feed line 25 is, by one of its ends, connected to an outlet end 27 of the impregnation vessel 3, which outlet end 27 thus comprises said outlet 24, and by its other end, to a top separator 28, which is arranged in the top of the digester 4 for separation of liquid from the chip-liquid mixture that has been fed in.

Figure 2:
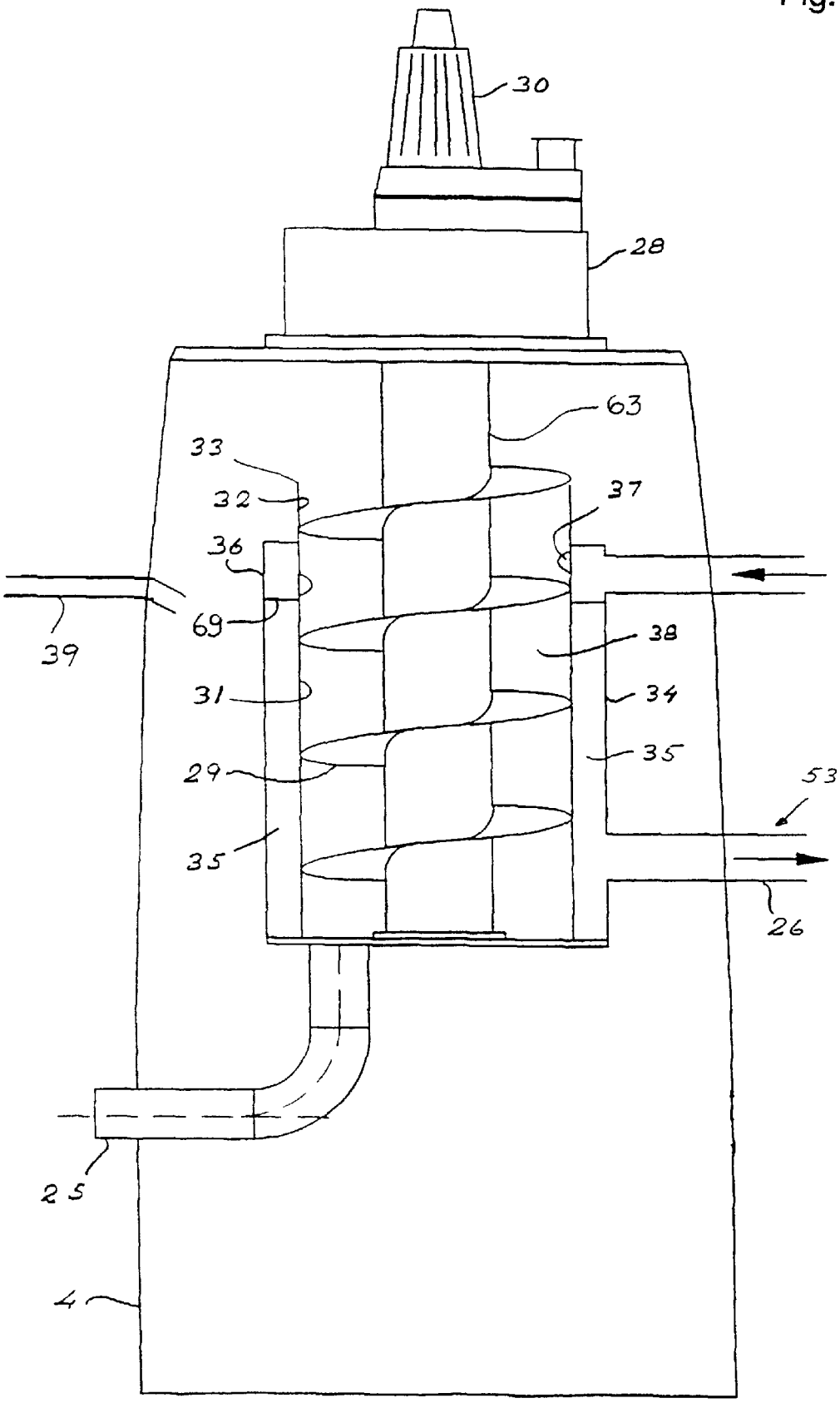
FIG. 2 shows a preferred embodiment of a separator positioned in the upper part of the digester according to FIG. 1.

As is more readily apparent from FIG. 2, the top separator 28 has a vertically arranged screw 29, which is driven by a motor 30, and a cylindrical body, in which the screw 29 rotates and which has a lower screen part 31 and a thereby following, upper part 32 which is not broken through and presents a free upper edge 33. The screen part 31 is surrounded by a concentric wall 34, which is not broken through, for formation of a liquid chamber 35, there between for collection of liquid, which is pressed out through the screen part 31 under influence of the screw 29.

The screenface 31 is preferably designed in accordance with our design described in PCT/SE94/00315, i.e. by the use of rigid vertically arranged rods, which are welded onto support rings so as to form gaps of about 3–10 mm, preferably about 4–7 mm, there between.

A ring shaped supply conduit 36 is arranged around the screw 29 within the area of the part 32, which is not broken through. Holes 37 are arranged in the supply conduit 36 and the part 32 which is otherwise not broken through for addition of white liquor and possibly other liquid to the chips, which moves upwards in the screw room 38 and from which a large part of the free liquid has been pressed out through the screen part 31, just before. The supply space 36 and the withdrawal space 35 are separated in a sealed manner. In the preferred case the distance between the supply space 36 and the upper edge of the screen 31 is less than the diameter (Ds) of the screw 29. According to the alternative shown in FIG. 2 they are positioned directly on top of each other, which is achieved by means of a concentric ring plate 69, e.g. by the use of welding. Also according to the shown embodiment the outer wall 34 of the withdrawal space 35 may be integral with the outer wall of the supply space 36.

The feed line 25 is connected to the bottom of the top separator 28. The return line 26 is connected to the liquid chamber 35. Medium pressure steam may be added via a line 39, to the upper steam room of the digester in the top of the digester 4 in connection with the top separator 28 in order to heat the chips (and free liquid) that are fed in by the screw 29 and which fall down over the free edge 33 of the part 32, which is not broken through.

The digester 4 has, within its middle part, a withdrawal screen 40 for withdrawal of black liquor via a line 41, that is connected to a first flash cyclone 42, which is in connection with a second flash cyclone 43 via a line 44. Effluent from the second flash cyclone 43 is led via a line 45, completely or partly, to a recovery plant (not shown). The steam which is formed in the flash cyclones 42, 43 can be used in different locations in the cooking process, for example for the steaming in the steaming vessels 1, 2. In the digester there is, in addition to top and middle circulations, a bottom circulation, which comprises a withdrawal screen 46 and a circulation line 49, which is equipped with a pump 47 and a heat exchanger 48, and which comprises a central line 50 that mouths at the withdrawal screen 46. Wash liquid is added to the bottom part of the digester 4 via a line 51. The digested chips are fed out through an outlet in the bottom of the digester 4 and are led away through a line 52 for further treatment.

The top separator 28 is further, with its liquid chamber 35, connected with the other flash cyclone 43 via a connection 53 which, in the embodiment shown, comprises the return line 26 and a branch line 54 to the same. A prechosen amount of liquid from the cooking system is withdrawn through the connection 53, which thus takes place with an existing screen device, that is, the top separator 28 in the digester which thereby achieves yet another function when it takes over the function of the conventional withdrawal screen in the impregnation vessel. In an alternative embodiment, the withdrawn liquid is led directly to recovery, without passing the flash cyclone.

White liquor is added to the top of the digester 4, via a line 55 which passes a heat exchanger 56. This heat exchanger can alternatively be excluded. A line 57 connects the return line 26 with the line 55 for white liquor for addition of withdrawn liquid from the top separator 28, when wished. This line 57 can alternatively be excluded. A line 58 is, further, connected to the line 55 for white liquor, for addition of wash liquid when wished. The heat exchanger 56 may work with low pressure steam, medium pressure steam or flash steam.

Instead of withdrawing liquid from a screen section in the impregnation vessel, necessary withdrawal of liquid is thus conducted on the liquor side of the transfer circulation.

An advantage of the invention is that the transfer circulation does not need to be heated, which means that chips which are fed out from the impregnation vessel 3 can keep a lower temperature than before, for example 130° C. as compared to previous 145° C., which in its turn has a beneficial effect on the pulp quality. The lower temperature in the transfer circulation will additionally decrease the risk of the problems which may occur in the top separator at the previously used high temperatures.

By adding the white liquor to the fibre material in connection with the top separator 28 downstream the location for the separation of the liquid, that is downstream the screen part 31, this addition of white liquor becomes completely separated from the transfer circulation so that the entire amount of white liquor normally can be used in the digester 4. The inlet for the white liquor is preferably situated inside the top separator in a blind zone 32, which surrounds the screw 29 and which is located above the screen part 31 itself. A good mixing of chips and white liquor is thereby secured by means of the influence of the screw 29, before the chips and the white liquor are fed out from the screw and fall down into the steam room of the digester. It is beneficial that the chips contain at least a small amount of free liquid when they leave the screen part 31 and are fed up into the blind zone 32, in order to thereby prevent that white liquor is drawn down into the screen part and is pressed out into the liquid chamber.

The relation between liquid and wood at the inlet of the impregnation vessel can, for example, be 3.5/1, but the invention makes it possible to use larger amounts of liquid, as for example up to 6/1 and above. The pressure in the impregnation vessel can, for example, be 10 bar overpressure and the temperature can, for example, be kept at 115–120° C. at the top or lower for example 90–100° C. Any displacement of liquid by withdrawal of liquid from the cooking system does thus not take place in the impregnation vessel.

White liquor is added to the top of the digester in an amount which is enough to obtain the wished delignification of the chips. The impregnated chips avail the white liquor through diffusion. Steam is added to adjust the cooking temperature to the wished level, for example within 140–170° C.

The liquid which is pressed out from the screw 29 and is collected in the liquid chamber 35 can be distributed in a suitable way with respect to transfer liquid, which is fed to the impregnation vessel via the return line 26, liquid which is complementary to the white liquor which is withdrawn through the line 57, and liquid which is withdrawn from the cooking system via the connection 53, that is, the line 26 and the branch line 54. The relation can, in the order given, be 20–30 m3/ADMT of pulp (to the impregnation vessel), 0–4 m3/ADMT of pulp (via the line 57) and 0.5–10 m3/ADMT of pulp (via the branch line 54), or sometimes even as much as 12–15 m3/ADMT. By attaching a line between the withdrawal screen 40 and the top of the impregnation vessel 3 the system shown in FIG. 1 may easily be connected to run according to the novel process, which process is described in more detail in our co-pending application PCT/SE97/00192 and also in connection with FIGS. 4 and 11 herein.

Figure 3:
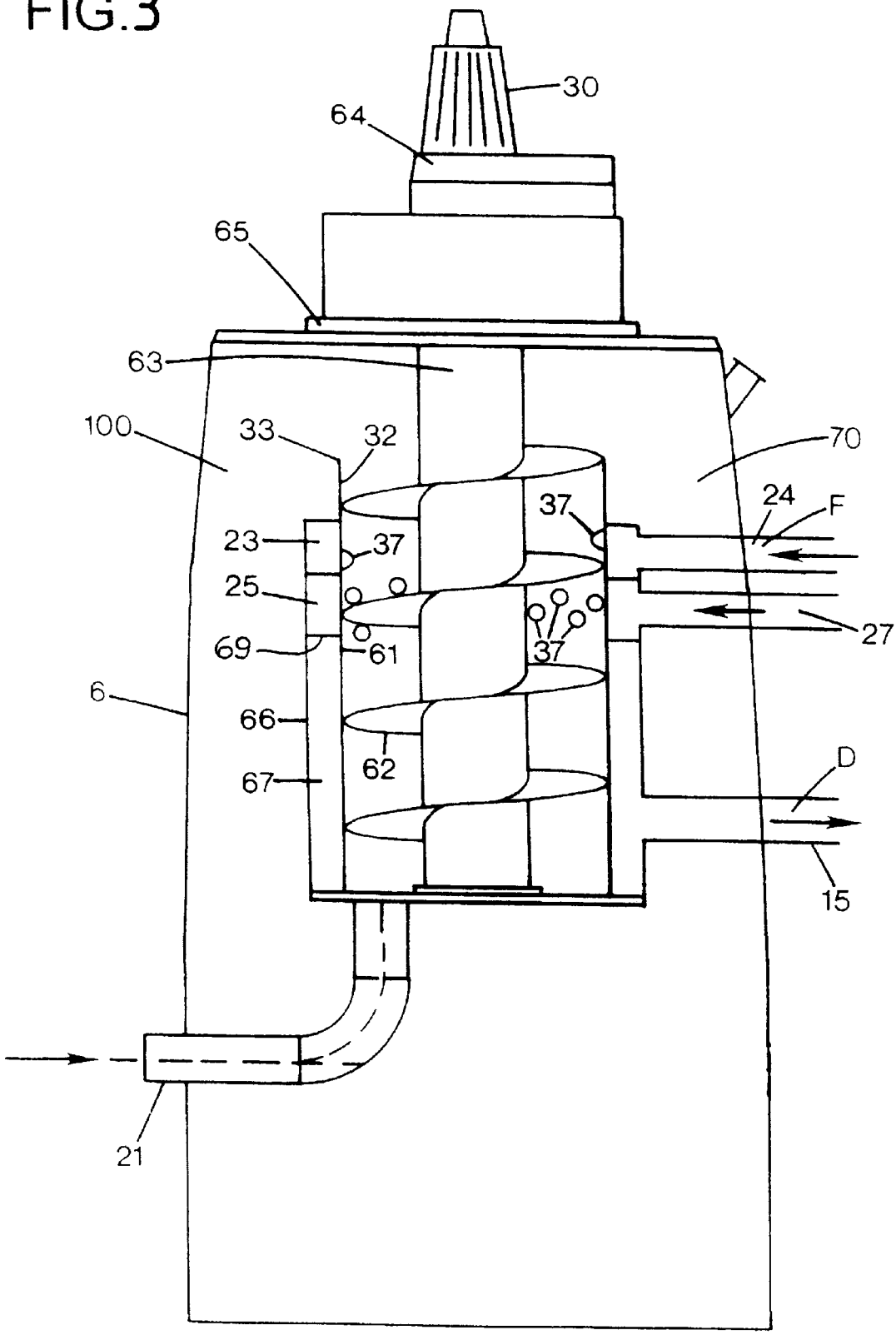
FIG. 3 is a cross-sectional view of a further embodiment of a separator according to the present invention.

In FIG. 3 there is shown a further embodiment of a separator to be used in connection with a steam/vapour phase digester, as described in FIG. 2. The separator of FIG. 3 is almost identical with the one shown in FIG. 2 except for the existence of a further supply space 25, being positioned below the first supply space 23. This further supply space 25 has as its object to provide for the possibility of supplying a further liquid to the up-moving chip pile. Especially for the possibility of supplying black liquor in order to secure a minimum amount of free liquid flowing upwardly in the chips pile, to eliminate back flow of the cooking liquor supplied above, in 23.

As in FIG. 2 circumjacent the screen basket 61 there is arranged a liquid collecting space 67, which may be connected to the return pipe circulation 15. Above the liquid collecting space 67, also circumjacent the screen basket 61, there is arranged a liquid supply space or opening 23 which is connected to the supply line 24 that supplies white liquor (F). The separator also has a plurality of inlet apertures 37 defined therein to subject the fiber chips with white liquor. The inlet apertures preferably has a total area that exceeds 400 mm2. More preferred, the total area of the inlet apertures is at least 500 mm2. Most preferred, the total area of the inlet apertures exceeds 600 mm2 to achieve a sufficient flow into the chip pile. Between the outer peripheral wall 66 of the liquid collecting space 67 and the liquid supply space 23 respectively, and the digester shell 6 at the top, there exist an annular space 70 which opens up down into the upper part of the digester 6. The functioning of the top separator may be described as follows.

The thoroughly heated and impregnated chips are transferred by means of the supply line 21 into the bottom portion of the screen basket 61. Here the screw feeder 62 moves the chips upwardly at the same time as the transport liquid D is separated from the chips, by being withdrawn outwardly through the screen basket 61 and further out of the digester through return line 15. More and more liquid will be withdrawn from the chips during their transport within the screen basket 61. First the chips will reach the level of the first supply space 25 where a desired liquor, for instance black liquor, is supplied. Eventually, the chips will reach the level of the supply space 23. Here the desired amount of cooking liquor, preferably white liquor, is added through the supply space 23 and the openings 37, having a temperature and effective alkaline content in accordance with the invention.

In order to eliminate the risk of back flowing of the supplied liquid from the supply space 23 into the liquid collection space 67, a minor amount of free liquid (at least about 0.5 m3/ADT) should be left together with the chips, which free liquid will then be mixed with the supplied cooking liquor. As explained above this may also be achieved by means of supply of free liquid through the intermediate supply space 25. Preferably, about one m3/ADT should be left together with the fiber material. Additionally, the white liquor should be provided at a point that is downstream of the flow of the suspension of the fiber material and the free liquid that is being fed through the screw member.

At the top of the screen basket 61, the chips and the cooking liquor may flow over the upper edge thereof and fall into the steam liquid space 70 and further on to the top of the chips pile within the digester, where the concurrent cooking zone (B) starts.

A major advantage of the separation device is that they provide for establishing a distinguished change of zones (they enable almost a total exchange of free liquid at this point), which means that for a two vessel system the desired conditions in the beginning of the concurrent zone (B) can easily be established.

Figure 4:
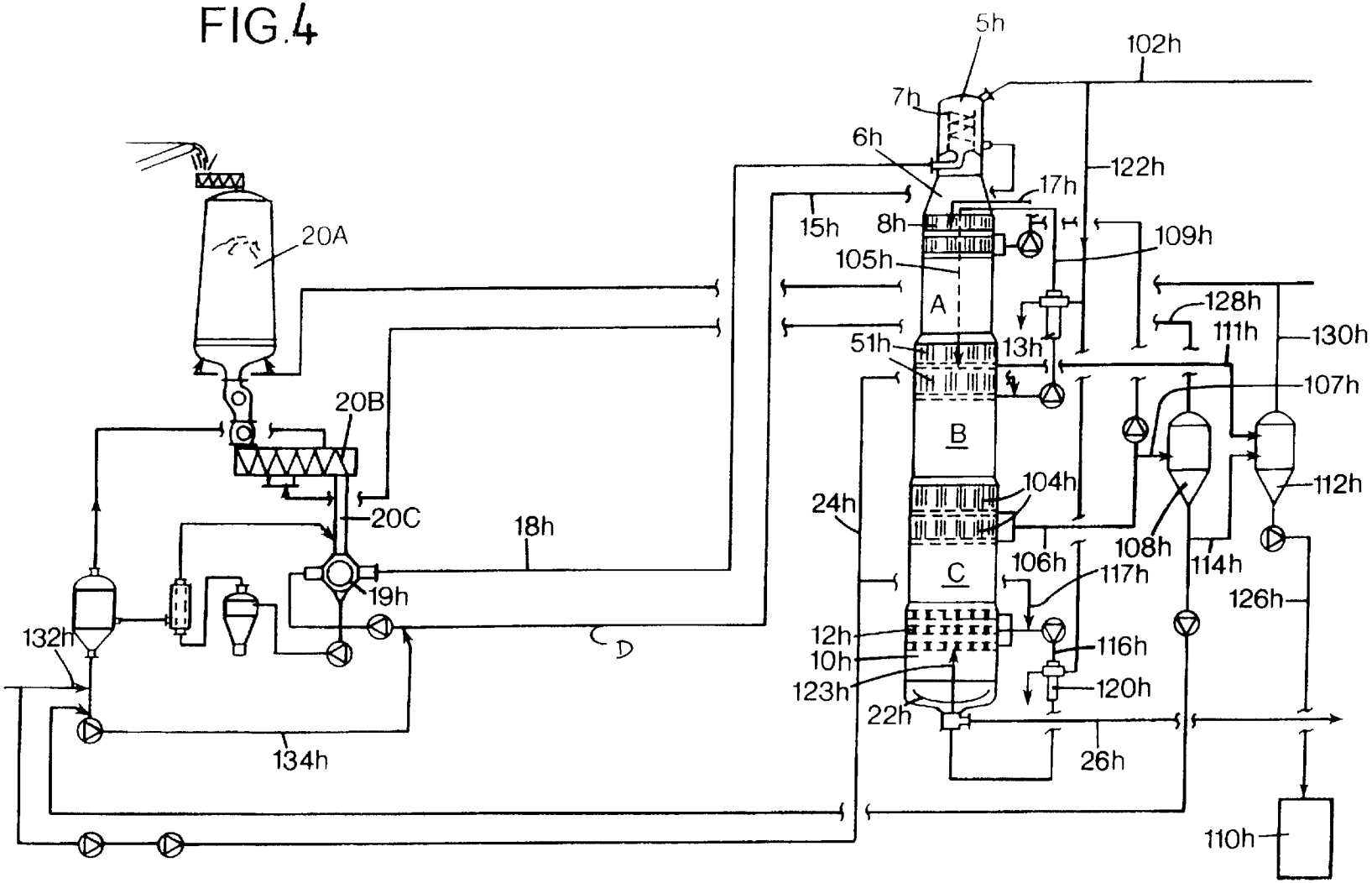
FIG. 4 is a schematic flow diagram of a one vessel steam-liquid digester using the novel process concept.

FIG. 4 illustrates a single vessel steam/liquid phase digester system, wherein a conventional type of top separator **7*h* is used. The chips are fed from a chip bin 20A, through a steaming vessel 20B and a chip chute 20C. A feeding device, preferably a high-pressure feeder 19*h* feeds the chips suspended in a transport liquid D via a conduit 18*h* to the top of a digester 6*h*. The feeder 19*h* is co-operating with the chute 20**C, and is connected to the necessary liquid circulations and replenishment.

The conduit **18*h* extends from the feeder 19*h* up to a top 5*h* of the digester 6*h*. The conduit 18*h* may open up at the bottom of the top separator 7*h* that feeds by means of a screw in an upwardly moving direction. The separator 7*h* has no supply space 36 as shown in FIG. 2. The screen of the separator may be used to draw off the transport liquid D (which is then returned in a return line 15*h*) together with which the chips are transported from the feeder 19*h* up to the top 5*h* of the digester 6*h*. A first screen girdle section 8*h* may be disposed immediately below or adjacent the separator 7*h*. A recirculation line 17*h* withdraws liquor and brings it back to a space that is defined between the first screen girdle section 8*h* and the separator 7*h* at the same time as withdrawn black liquor is added. This recirculation improves the distribution of the black liquor withdrawn from screen section 104*h*** and added to the impregnation zone A, in order to run the digester according to the novel process.

A second screen girdle section **51*h* is disposed below the first screen girdle section 8*h* so that an impregnation zone A is defined between the screen girdle sections 8***h* and 51*h*. We have found indications that it is desirable to keep the alkaline level at above at least 2 g/l, preferably above 4 g/l, in the impregnation zone A in connection with black liquor, which would normally correspond to a pH of about 11. If not, it appears that dissolved lignin precipitate and even condense. Spent liquor may be withdrawn from the upper screen of the section 51*h* and conducted with a conduit 111*h* to a second flash tank 112*h*. Spent liquor is withdrawn via a conduit 109*h* from a lower screen of the section 51*h* and conducted back to the space defined above the first screen girdle section 8*h* so that the spent liquor may be reintroduced back to the lower screen of the second screen girdle section 51*h* via a central pipe 105*h*. The temperature of the spent liquor may be controlled by a heat exchanger 13*h*. The heat exchanger 13*h* is in operative engagement with a high pressure steam line 102*h* via a conduit 122*h*.

A cooking liquor conduit 24*h* is operatively attached to the conduit 109*h* to supply a cooking liquor, such as white liquor, to the conduit 109*h*. The effective alkali of the liquor in the conduit 109*h* is at least about 13 g/l; more preferably at least about 16 g/l; and, most preferably, between about 13 g/l and about 30 g/l.

Approximately 95% of the total supply of the white liquor is conducted in the conduit 24*h* and the remaining 5% is supplied to the high pressure feeder 19*h* via a conduit 132*h* and a conduit 134*h* to lubricate the high pressure feeder 19*h*.

A third screen girdle section 104*h* may be arranged below the second screen girdle section 51*h* so that a concurrent cooking zone B is defined between the screen girdle sections 51*h* and 104*h*. Draw-off from the third screen section 104*h*, such as spent liquor, i.e., black liquor, may be conducted via a conduit 106*h* back to the conduit 17*h*. A portion of the black liquor in the conduit 106*h* may be conducted to a first flash tank 108*h* via a conduit 107*h* to cool the spent liquor before the liquor is conducted to a recovery unit 110*h*. Preferably, the spent liquor is also conducted through a second flash tank 112*h* via a conduit 114*h* to further reduce the temperature and pressure of the spent liquor before the liquor is conducted to the recovery unit 110*h*. The spent liquor from both flash tanks 108*h*, 112*h* are then conducted with a conduit 126*h* to the recovery unit 110*h*. Conduits 128*h* and 130*h* may be connected to the flash tanks 108*h*, 112*h*, respectively, to provide steam that is sent to the chip bin 20A and the steaming vessel 20B.

At a bottom 10*h* of the digester 6*h*, there is a feeding-out device including a scraping element 22*h*. A fourth lower screen girdle section 12*h* is disposed at the bottom 10*h* of the digester 6*h* so that a counter-current cooking zone C is defined between the sections 104*h* and 12*h*. The girdle section 12*h* may, for example, include three rows of screens for withdrawing liquid, which is heated and to which some white liquor, preferably about 10% of the total amount of the white liquor in the conduit 24*h*, is added via a branch conduit 117*h* before it is recirculated by means of a central pipe 123*h*, which opens up at about the same level as the lowermost strainer girdle 12*h*.

The draw-off from screen girdles 12*h* and the white liquor from the branch conduit 117*h* are preferably conducted via a heat exchanger 120*h* back to the bottom 10*h* of the digester 6*h*. The conduit 122*h* is connected to the heat exchanger 120*h* to provide the heat exchanger 120*h* with steam to regulate the temperature of the liquor in the conduit 116*h*. The white liquor is supplied in a counter-current direction via the central pipe 123*h* to the screen girdle section 12*h*. The white liquor provides fresh alkali and, in the form of counter-current cooking, further reducing the kappa number. A blow line 26*h* may be connected to the bottom 10*h* of the digester for conducting the digested pulp away from the digester 6*h*.

The installation, as shown in FIG. 4, using our novel process (but not the specific invention presented herein) may be described as follows. The chips are fed into the chip bin 20A and are subsequently steamed in the vessel 20B and, thereafter, conveyed into the chute 20C. The high-pressure feeder 19*h*, which is supplied with a minor amount of white liquor (approximately 5% of the total amount to lubricate the feeder), feeds the chips into the conduit 18*h* together with the transport liquid. The slurry of chips and the liquid are fed to the top of the digester 6*h* and may have a temperature of about 110–120° C. when entering the digester 6*h* (excluding recirculated transport liquor).

Inside the top of the digester 6*h*, there is the top separator 7*h* that pushes chips in an upward direction through the separator and then the chips move slowly downwards in a plug flow through the impregnation zone A in a liquid/wood ratio between 2/1–10/1 preferably between 3/1–8/1, more preferred of about 4/1–6/1. The liquor, which is drawn off from the screen girdle section 8*h*, may be recirculated via the conduit 17*h* to the space below the top separator 7*h*. The chips are then thoroughly impregnated in the impregnation zone A.

The retention time in the impregnation zone A should be at least 20 minutes, preferably at least 30 minutes and more preferred at least 40 minutes. However, a shorter retention time than 20 minutes, such as 15–20 minutes may also be used. The volume of the impregnation zone A may be larger than 1/11, preferably larger than 1/10 of the volume of the digester 6*h*. Additionally, in the preferred embodiment, the volume V of the impregnation zone A should exceed 5 times the value of the square of the maximum digester diameter, i.e., $V=5D^2$, where D is the maximum diameter of the digester 6*h*.

The chips, which have been thoroughly impregnated and partially delignified in the impregnation zone A, are then passed into the concurrent cooking zone B.

A spent liquor is withdrawn at the upper segment of the screen section 51*h* and conducted to the second flash tank 112*h*. A spent liquor is also withdrawn at the lower segment of the section 51*h* and reintroduced via the central pipe 105*h* with the addition of white liquor supplied by the conduit 24*h*.

The chips move down in the concurrent zone B through the digester 6*h* at a relatively low cooking temperature, i.e., between 130–160° C., preferably about 140–150° C. The major part of the delignification takes place in the first concurrent cooking zone B.

The liquid-wood ratio should be at least 2/1 and should be below 7/1, preferably in the range of 3/1–5.5/1, more preferred between 3.5/1 and 5/1. (The liquid wood-ratio in the counter-current cooking zone should be about the same as in the concurrent cooking zone.)

The temperature in the lower counter-current zone C may in connection with some installation be higher than in the concurrent zone B. The alkali content in the lowermost part of the counter-current cooking zone C may in such installations preferably be lower than in the beginning of the concurrent zone B. Expediently, the conduit 116*h* may be charged with about 5–20%, preferably 10–15%, white liquor from the conduit 24*h* via the conduit 117*h*.

The temperature of the liquid which is recirculated via the pipe 123*h* up to the screen girdle section 12*h* is regulated with the aid of the heat exchanger 120*h* so that the desired cooking temperature is obtained at the lowermost part of the counter-current cooking zone.

Figure 5:
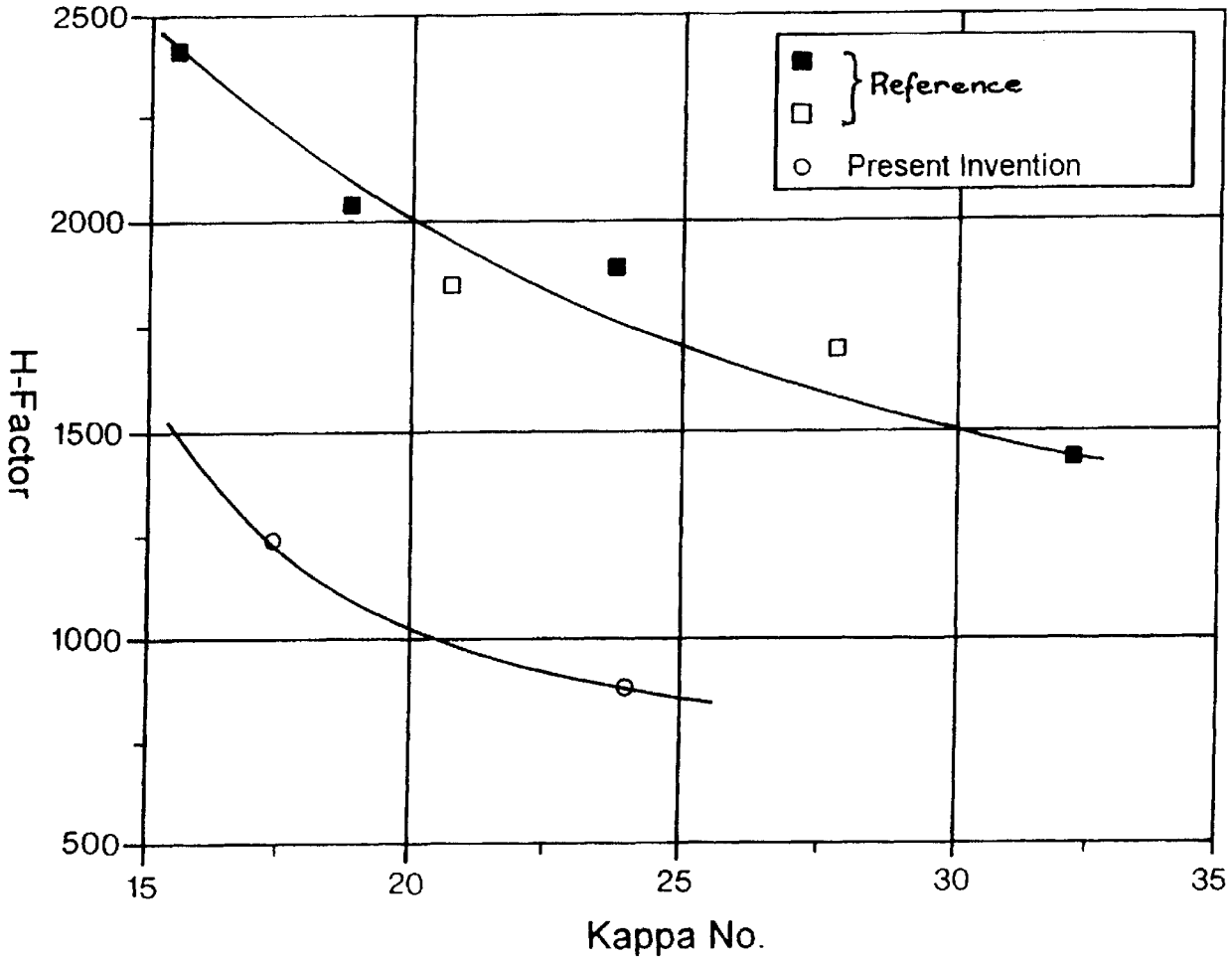
FIG. 5 shows a diagram presenting the advantages related to the H-factor when using the invention.

In FIG. 5, there is shown a diagram comparing the H-factor for pulp produced according to a conventional ITC™-cooking process and according to the cooking process of the present invention. The H-factor is a function of time and temperature in relation to the delignification process (degree of delignification) during the cooking process. The H-factor is used to control the delignification process of a digester, i.e., maintaining a certain H-factor principally leads to the same Kappa number of the produced pulp (remaining lignin content of the fiber material) independent of any temperature variations during the cooking process.

In FIG. 6, it is shown that the H-factor for pulp produced according to the present invention is extremely much lower (about 40–50% lower) compared to pulp produced according to ITC. This means that much lower temperatures may be used for the same retention time in order to reach a certain degree of delignification (Kappa number) and/or that smaller vessels for the cooking within a continuous digester can be used and/or that a lower Kappa number may be achieved with the same kind of basic equipment and/or that higher rate of production can be obtained.

The lower H-factor demand is achieved by a high alkali concentration and a low cooking temperature in the concurrent cooking zone, which presents one reference ITC-cook (ITC 1770) and one cook according to the present invention (modified ITC* 1763). As shown, the temperature in the counter-current cooking zone, according to the present invention, is higher than in the concurrent zone but still lower than the temperature in the counter-current zone in the ITC-reference.

Figure 7:
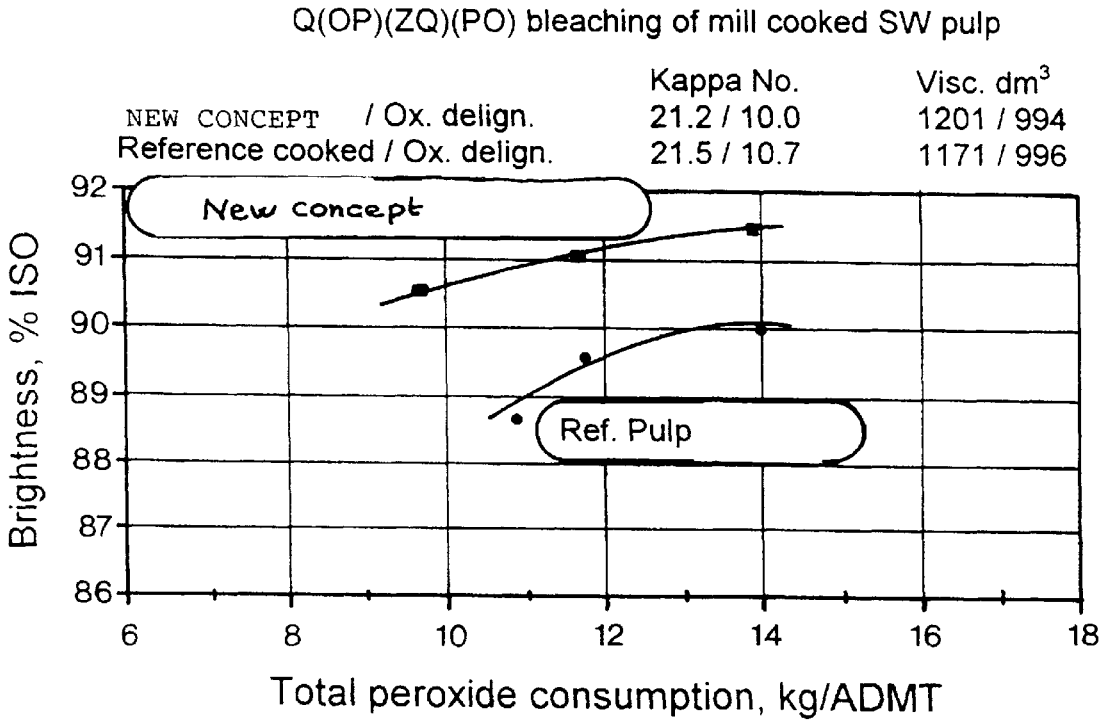
FIG. 7 shows test data related to peroxide consumption and brightness for the present (compact) method compared to a conventional process.

FIG. 7 shows results from TCF bleaching using the novel cooking process (so called "new concept") of the present invention compared to a conventional reference cooking process. The present invention provides a TCF-bleached pulp having extremely good bleachability, i.e. a higher brightness is achieved compared to the conventional process for the same amount of peroxide consumption, and also a higher brightness ceiling is obtained.

Figure 8:
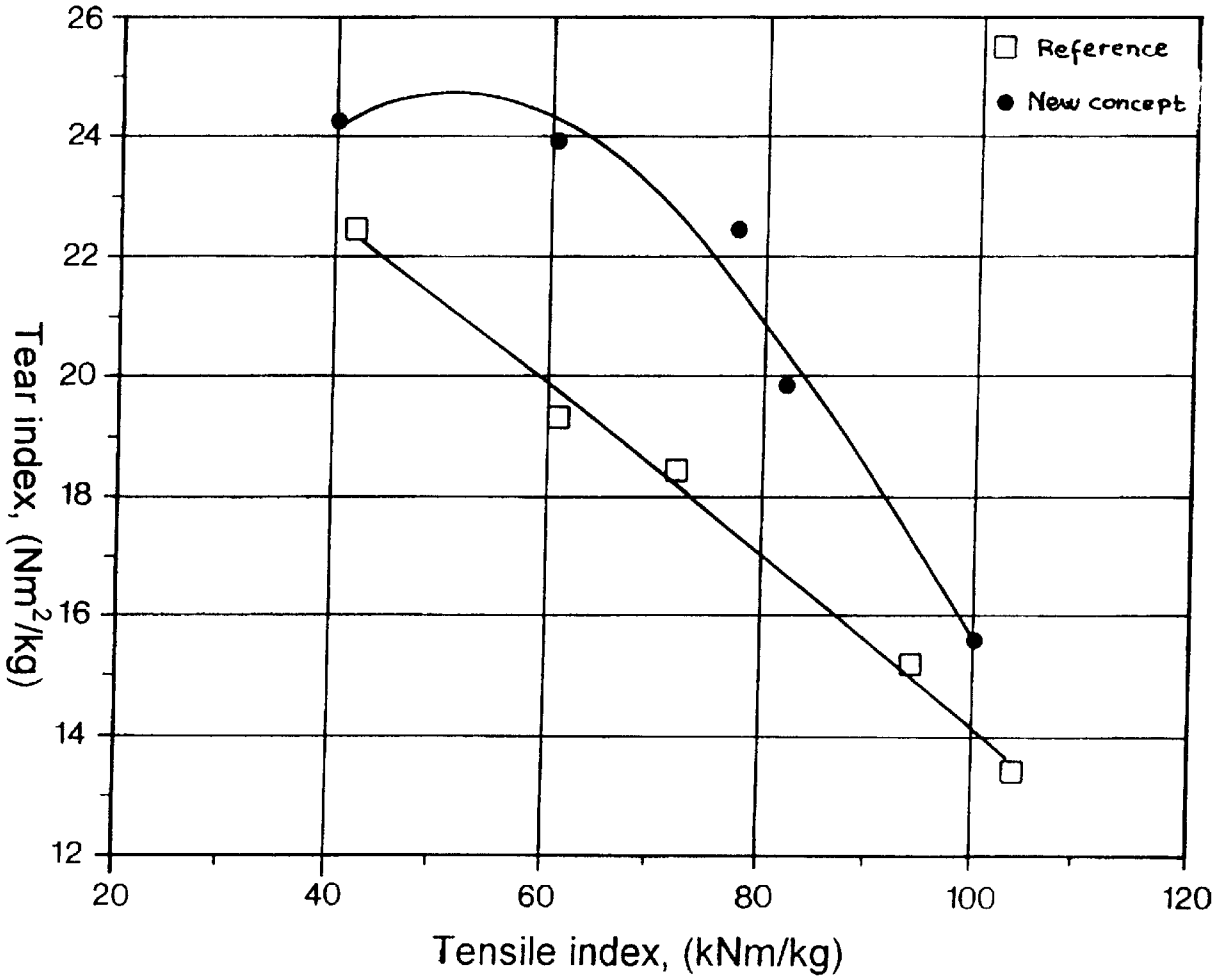
FIG. 8 shows test data related to tensile index and tear index for the present (compact) method compared to a conventional process.

FIG. 8 shows the tear index relative to the tensile index. The test data compares results obtained by the novel cooking process ("new concept") of the present invention with a conventional cooking process ("ITC-reference").

Figure 9:
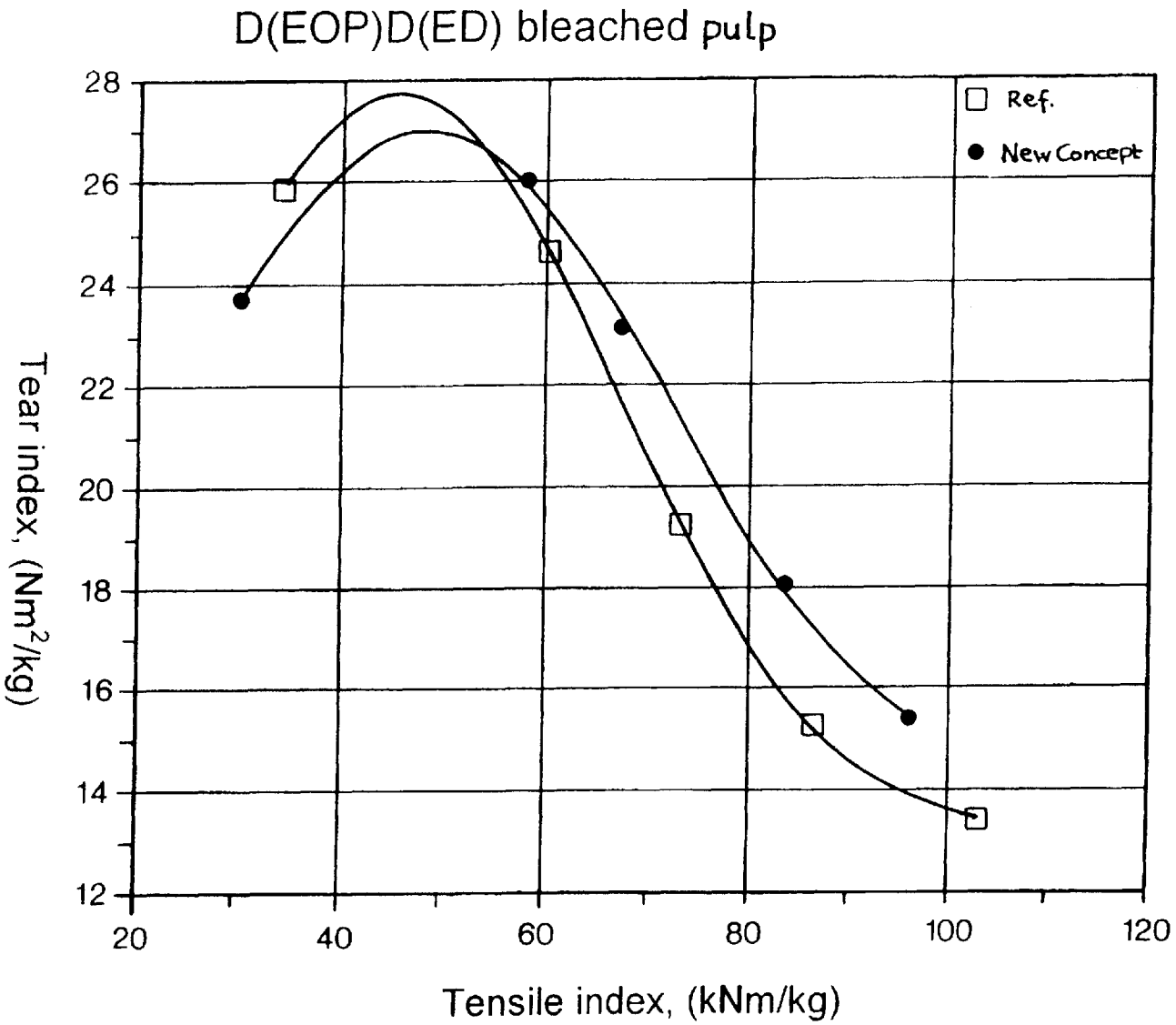
FIG. 9 shows test data related to tensile index and tear index for the present compact method compared to a conventional process.

Similarly, FIG. 9 compares test data for the novel process with those from a conventional process. As can be seen the present invention exhibits better tensile index compared to the conventional method.

Figure 10:
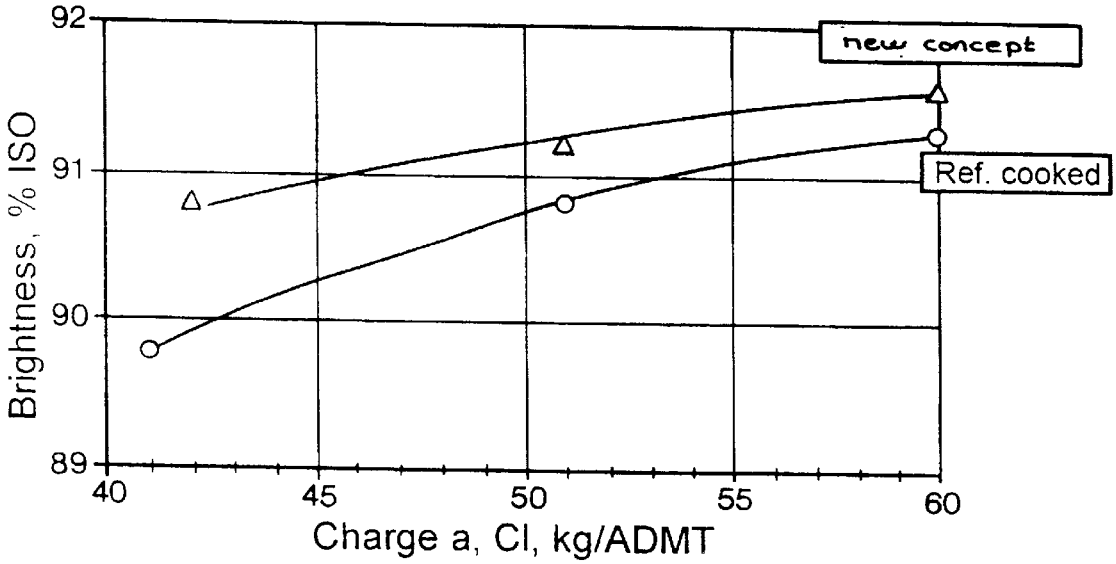
FIG. 10 shows test data related to Cl charge and brightness for the present (compact) method compared to a conventional process.

FIG. 10 shows the brightness level by using the novel process ("new concept") with reference cooked pulp . The novel cooking process of the present invention exhibits a higher brightness compared to the conventional cooking process.

Figure 11:
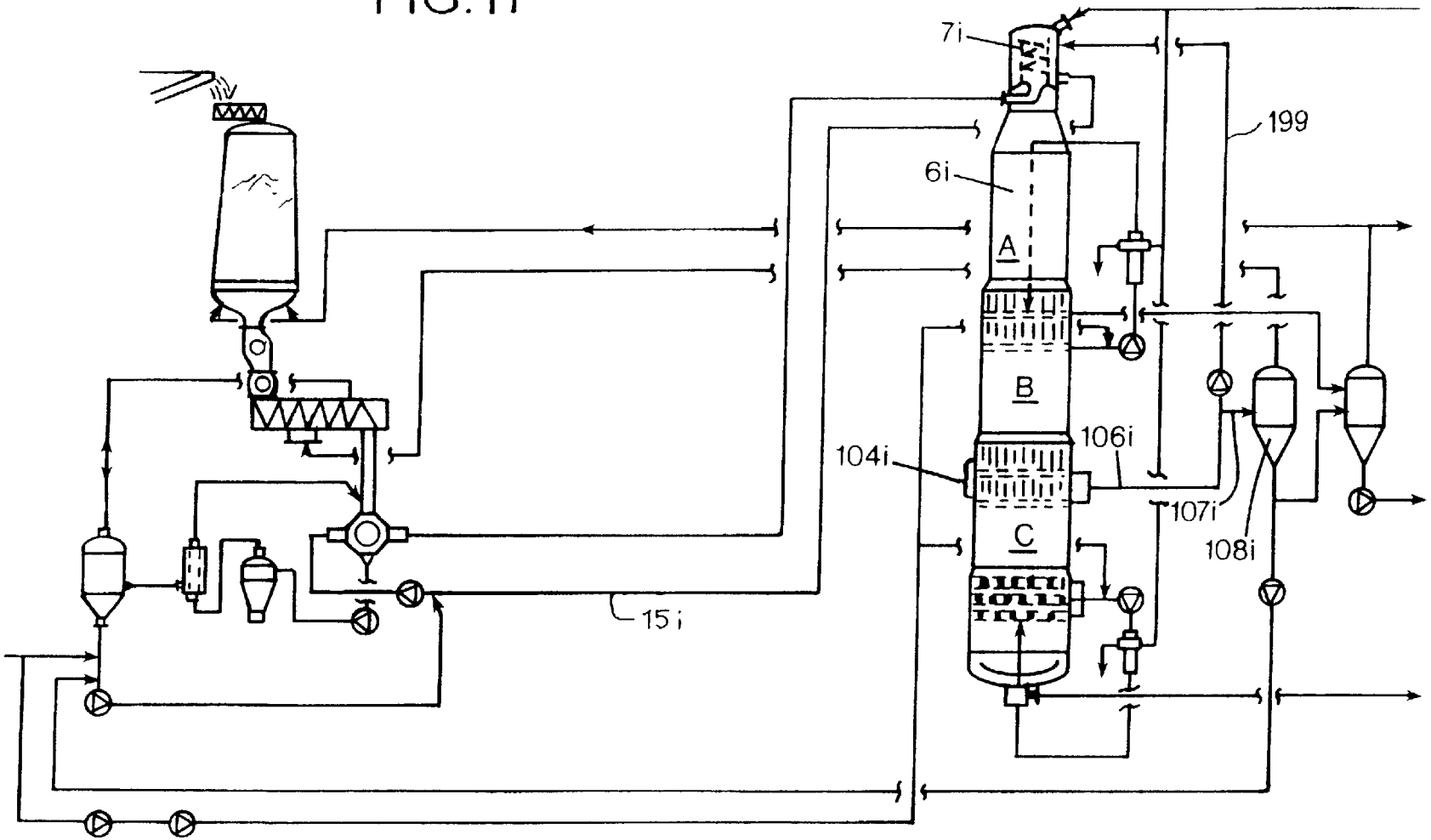
FIG. 11 shows a slight modification of the embodiment shown in FIG. 4, whereby some of the features of this invention and the novel process is used in a single vessel digester system.

FIG. 11 shows principally the same system as described in FIG. 4. In contrast to FIG. 4, however, a top separator 7*i* according to the invention is used. Accordingly this top separator 7*i* is arranged with one (or more) supply space 36 as described in detail in relation to FIG. 2. This arrangement does eliminate the need of any circulation in the top of the digester (see screen 8*h* and re-circulation line 17*h*, shown in FIG. 4). Instead hot black liquor may be supplied to the beginning of the impregnation zone by means of line 199 which with draws liquor from withdrawal strainer 104I, without risqué for getting a too high temperature in the return line. Consequently the use of this specific invention adds further advantages than described in conjunction with FIG. 4 in connection with running of our novel process.

Figure 12:
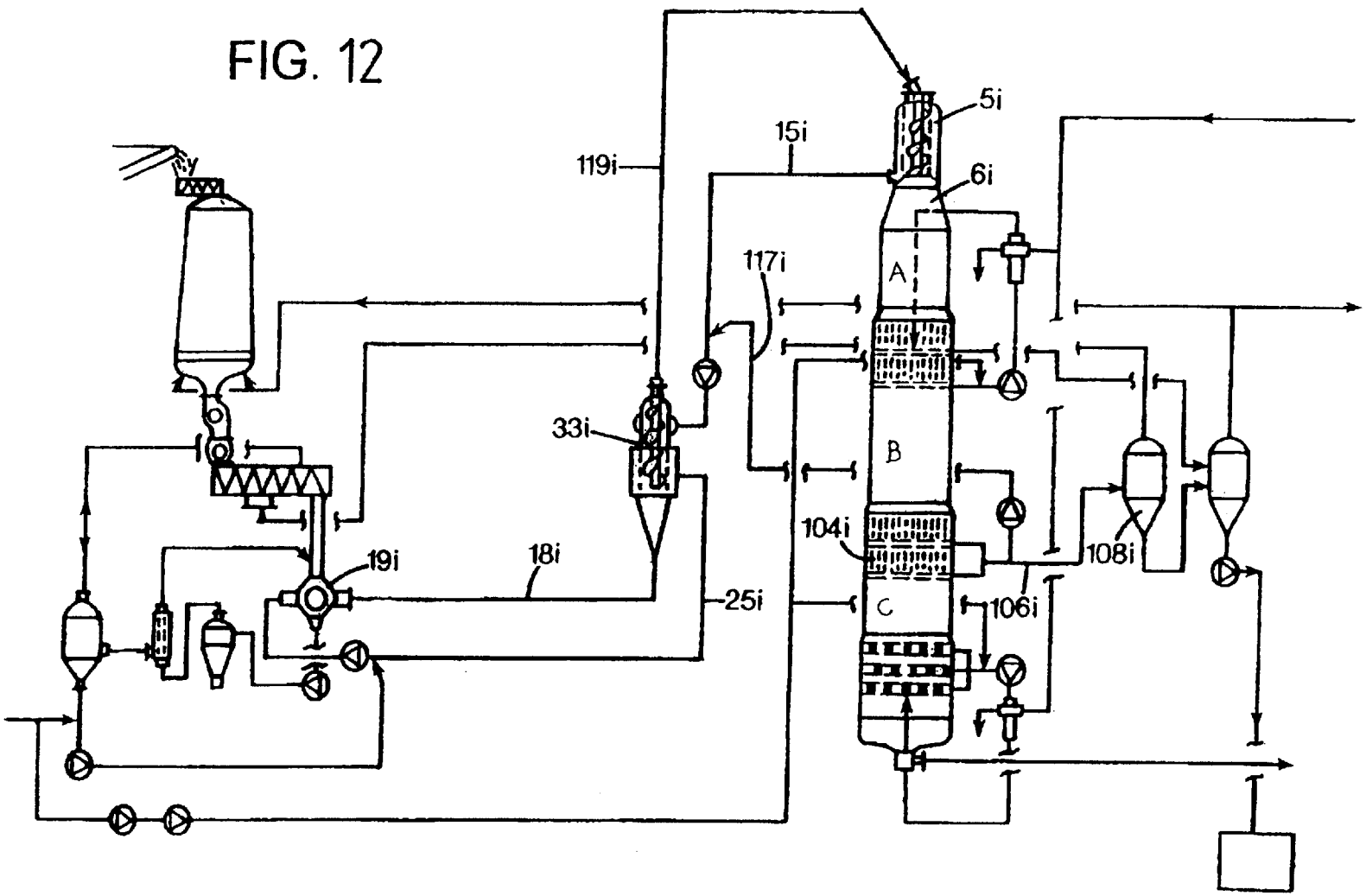
FIG. 12 shows a further embodiment of a one vessel digester using the novel process.

FIG. 12 illustrates an embodiment of a one vessel hydraulic digester wherein the novel process is used but without the use of the present invention, in order to demonstrate the simplifications rendered thereby. Since the digester is hydraulic it has a downwardly feeding top separator 5*i*. In order to achieve a desired/sufficient exchange of liquid, a liquid exchanger 33*i* is arranged in the transfer line 18*i*, 119*i*. This liquid exchanger may be designed in accordance with prior art exchangers, having the separation unit at the bottom, a very long screw to feed the chips all the way through it and a separate supply space positioned far above the separation unit. Chips and a transport fluid is pumped up in a conduit 18*i* and a conduit 119*i* to a top section 5*i* of a digester 6*i* via a separator 33*i*, wherein liquid is exchanged before the chips enter the top section 5*i* of the digester 6*i*.

A portion of the transport liquid may be returned in return line 15*i* that leads from the top portion 5*i* to a mid-section of the liquid exchanger 33*i* and then back to a feeder 19*i* via a conduit 25*i*. The conduit 106*i* conducts the spent liquor withdrawn from a screen girdle section 104*i* to the liquid from 117*i* and to the conduit 15*i*. A portion of the liquor in the conduit 106*i* may be sent to a flash tank 108*i*. When comparing FIGS. 12 and 11 the enourmous advantages of the invention are apparent, i.e. by the use of the invention only one separator is needed and since the liquid exchanger may be eliminated all its circulation lines, pump, valves, etc. are also eliminated implying a considerable cost reduction not only investment wise but also from a maintenance perspective.

According to the novel process the black liquor supplied into the impregnation zone A has a high content of rest alkali, (effective alkali EA as NaOH), at least 13 g/l, preferably about or above 16 g/l and more preferred between 13–30 g/l in the top of the impregnation zone A. This alkali mainly comes from the black liquor due to the high amount of alkali in the concurrent zone B of the digester 6*h*. Furthermore, the strength properties of the fibers are positively affected by the impregnation because of the high amount of sulphide. A major portion of the black liquor may directly (or via one flash tank) be fed into the impregnation zone A. The total supply of black liquor to the impregnation zone A may exceed 80% of the amount drawn off from the draw-off screen girdle section 104*h*, preferably more than 90% and optimally about 100% of the total flow, which normally is about 8–12 $m^3$/ADT.

The retention time in the impregnation zone A should be at least 20 minutes, preferably at least 30 minutes and more preferred at least 40 minutes. However, a shorter retention time than 20 minutes, such as 15–20 minutes may also be used. The volume of the impregnation zone A may be larger than 1/11, preferably larger than 1/10 of the volume of the digester 6. Additionally, in the preferred embodiment, the volume V of the impregnation zone A should exceed 5 times the value of the square of the maximum digester diameter, i.e., $V=5D^2$, where D is the maximum diameter of the digester 6.

The invention is not limited to what is described above, but can vary with the scope of the appendant claims. For example, the invention may also be performed in connection with an impregnation vessel having the inlet at the bottom and which accordingly has an upward flow of the chips. Furthermore it is understood that instead of an annular distribution ring for supply of cooking liquor, a number of nozzles may be used, or even spray nozzles as described in PCT/SE94/01230.

While he present invention has been described in accordance with preferred compositions and embodiments, it is to be understood that certain substitutions and alterations may be made thereto without departing from the spirit and scope of the following claims.

What is claimed is:

1. A separator system for wood chips disposed in a feed line extending between an impregnation vessel and a digester, comprising:

a screw feeder having an inlet end and an outlet end for feeding wood chips in an upward direction from the inlet end towards the outlet end of the screw feeder;

a rotatable shaft in operative engagement with the screw feeder;

a drive unit attached to the rotatable shaft for rotating the rotatable shaft;

a cylindrical body having a lower screen basket and an upper part enclosing the screw feeder;

a withdrawal space defined between an outer wall and the lower screen basket for separating a substantial portion of a free liquid from the wood chips, the withdrawal space being in fluid communication with a return line connected to an outlet of the impregnation vessel;

a first supply space defined by an annual ring disposed downstream of the withdrawal space in relation to a flow of the wood chips for supplying a cooking liquid to the wood chips, the annual ring being arranged about the screw feeder disposed within the upper part of the cylindrical body; and a plurality of symmetrically positioned openings defined in the upper part of the cylindrical body to provide a passage way from the annual ring to an inside of the separator system, the plurality of openings having a total area exceeding about 400 $mm^2$ to provide a sufficient flow capacity.

2. A separator system according to claim 1 wherein the separator system further comprises a recovery line in fluid communication with the return line to withdraw a spent liquor from the return line and conduct the spent liquor to a recovery unit.

3. A separator system according to claim 1 wherein the separator system defines a first supply space that is disposed above the withdrawal space and has a lower screen basket having an upper edge, the first supply space is disposed a first distance from the upper edge, the screw feeder has a diameter, the first distance is less than the diameter.

4. A separator system according to claim 3 wherein the first supply space is disposed adjacent the outer wall that partially defines the first supply space and the withdrawal space.

5. A separator system according to claim 1 wherein the first supply space is directly disposed above a partition ring that separates the first supply space from the withdrawal space.

6. A separator system according to claim 1 wherein the separator system defines a second supply space for supplying a second liquid that is different from the cooking liquid supplied through the first supply space.

7. A separator system according to claim 6 wherein the second supply space is positioned between the first supply space and the withdrawal space.

8. A separator system according to claim 1 wherein the separator system is disposed at a top of a digester.

* * * * *